US005343018A

United States Patent [19]

Limbach

[11] Patent Number: 5,343,018

[45] Date of Patent: Aug. 30, 1994

[54] MICROSCOPE LENS AND STAGE HEATER WITH FLEXIBLE OBJECTIVE LENS CASING HEATER SLEEVE

[75] Inventor: Steven T. Limbach, Sun Prairie, Wis.

[73] Assignee: Wisconsin Alumni Research Foundation, Madison, Wis.

[21] Appl. No.: 969,656

[22] Filed: Oct. 30, 1992

[51] Int. Cl.[5] ..... H05B 3/00

[52] U.S. Cl. ..... 219/200; 219/535; 219/544; 359/820; 359/656; 359/395

[58] Field of Search ..... 219/200, 201, 535, 385, 219/544; 359/395, 820, 656; 354/65

[56] References Cited

U.S. PATENT DOCUMENTS

| | | | |
|---|---|---|---|
| 1,830,221 | 11/1931 | Blue | 219/535 |
| 2,342,513 | 2/1944 | Gaty | 219/201 |
| 2,442,913 | 6/1948 | Abrams et al. | 359/820 |
| 2,625,643 | 1/1953 | Cordis | 219/535 |
| 2,985,742 | 5/1961 | Rea | 219/535 |
| 3,969,013 | 7/1976 | Poty et al. | 359/390 |
| 4,165,918 | 8/1979 | Moreno . | |
| 4,176,662 | 12/1979 | Frazer . | |
| 4,279,255 | 7/1981 | Hoffman | 219/535 |
| 4,281,238 | 7/1981 | Noma et al. | 219/535 |
| 4,355,861 | 10/1982 | Sebald | 219/201 |
| 4,485,407 | 11/1984 | Bohm et al. | 358/229 |
| 4,549,069 | 10/1985 | Oge | 219/535 |
| 4,629,862 | 12/1986 | Kitagawa et al. . | |
| 4,674,846 | 6/1987 | Lippman . | |
| 4,722,000 | 1/1988 | Chatenever | 358/98 |
| 4,736,218 | 4/1988 | Kutman | 354/81 |
| 4,888,463 | 12/1989 | Middlebrook . | |
| 5,173,585 | 12/1992 | Dokken | 219/201 |
| 5,181,382 | 1/1993 | Middlebrook | 219/201 |

FOREIGN PATENT DOCUMENTS

| | | | |
|---|---|---|---|
| 2417233 | 10/1979 | France | 219/535 |
| 63-149619 | 6/1988 | Japan | 359/395 |

OTHER PUBLICATIONS

Silinex ® Electrofilm Inc. Heating Element Brochure, Feb. 12, 1976, Electrofilm, Inc., 7116 Laurel Canyon Blvd., N. Hollywood Calif. 91605.

Verbit et al, "A Versatile Variable Temperature Microscope Stage", J. Chem. Ed. (USA), V. 48, N. 11, Nov. 1971.

Minco Products Inc., "Thermofoil Heater Kit", Minco Products, 7300 Commerce Ln., Minneapolis Minn. 55432, Mar. 1970.

Bioptechs, Inc. Optics for Biology, Butler, Pa., brochures describing the Focht Chamber System.

*Primary Examiner*—Bruce A. Reynolds
*Assistant Examiner*—John A. Jeffrey
*Attorney, Agent, or Firm*—Ross & Stevens

[57] ABSTRACT

A system for maintaining desired temperature control of a specimen observed under a microscope includes an objective lens heater comprising a heating element placed within a heat sleeve, which surrounds the objective lens casing. When an electric current is applied, the heating element is activated, heating the objective lens to a desired temperature. The heated objective lens may be used in combination with a stage heater to ensure that the specimen will be maintained at a desired physiological temperature during observation.

6 Claims, 2 Drawing Sheets

MICROSCOPE LENS AND STAGE HEATER WITH FLEXIBLE OBJECTIVE LENS CASING HEATER SLEEVE

This invention was made with the United States Government support awarded by the National Institute of Health (NIH), grant number GM25062 and GM30385. The United States government has certain rights in this invention.

FIELD OF THE INVENTION

The invention is directed to a system for heating and controlling the temperature of specimens observed under a microscope. The invention is specifically directed to a microscope lens heating system designed to maintain the physiological temperature of a specimen while the specimen is being viewed under a microscope.

BACKGROUND OF THE INVENTION

Microscopes are optical instruments used to examine minute specimens by presenting an enlarged, well-resolved image of the specimen for the observer. For purposes of the present invention, the term "specimen" includes living tissue and cells to be observed via a microscope under physiological conditions. A compound microscope includes an objective lens and an eye piece mounted in a tube with a variable apparatus for directing and concentrating light on the specimen.

In order to accurately observe living specimens under a microscope, the physiological conditions required to maintain the viability of the specimen should be duplicated. For example, physiological conditions for living cells generally means keeping the cells at a physiological temperature, i.e., between approximately 32° and 38° C. At these temperatures, cells will remain healthy and retain physiological activity, i.e., normal metabolism, motility and growth.

Several methods have been used in the prior art to maintain a particular specimen at a required physiological temperature when the specimen is being viewed under a microscope. One of the earliest methods placed the microscope and the operator in a "warm room," i.e., a room in which the thermostat had been set at the desired physiological temperature. Under these conditions, the specimen could be observed at the desired temperature. However, there are several drawbacks to the use of a warm room. First, not everyone has access to a warm room facility. The size of the room and its heat control create a substantial investment in location and cost. Another disadvantage is that the user is also subject to "warm room" conditions, which can be uncomfortable over a long period of time. Further, the temperature conditions cannot be rapidly changed. For example, if the user wanted to change the conditions from 38° C. to 32° C., all of the equipment in the room would have to be moved, cooled and re-equilibrated to the new temperature. This process could take several hours and would have to be done under dry conditions to avoid condensation on the optic lenses. Other problems, such as subjecting photographic film and/or electronic cameras to elevated heat are also apparent.

Another specimen heating system includes the use of stage heaters. Stage heaters work on the principle of heating the specimen in a dish such as a petri dish, in which the tissue culture is growing. The stage heater is designed to heat the sides and lower rim of the dish or chamber. Reference is made to U.S. Pat. No. 4,629,862 to Kitagawa et al. and U.S. Pat. No. 4,888,463 to Middlebrook for a description of microscope stage heaters. The limitations to stage heaters include the size of the device. As with other temperature controlled approaches, stage heaters often take up a great deal of room on the stage limiting access for research manipulation. This is especially true for water-jacket stage heaters, which require water lines entering the stage heater area.

Another disadvantage with stage heaters is that they have difficulty adjusting for changes in temperature gradient. This limitation is especially apparent with microscopes employing oil immersion lenses. Oil immersion lenses are designed to touch the specimen dish, slide or plate. A drop of lens oil is placed between the lens and the specimen dish. By touching the specimen dish, the lenses become a heat sink drawing heat from the specimen. Thus, although the culture dish containing the specimen may be heated, the area actually being observed, i.e., the area adjacent the objective lens, may be 3 to 12° cooler than the rest of the specimen dish due to the contact between the cooler objective lens and the specimen dish. Therefore, an effective specimen heating system must heat not only the specimen dish but also the objective lens of the microscope.

One approach to heating both the specimen dish and the objective lens is by infrared radiation with a thermistor-controlled heat lamp. Typically, a lamp is placed above the stage to warm the sample and stage area and another lamp is placed below the stage to heat the objective lens and the bottom of the specimen container. However, because heat is provided with a lamp, it is difficult to maintain a constant temperature. Even with thermistor control, the lamp or lamps tend to cycle on and off. The heat-absorbing surfaces of the microscope will expand and contract with the cycling. This condition subjects the specimens to varied temperature changes over time. It also affects the focus of the optical system causing focus drift and instability. Additionally most lamps are bulky and crowd the area around the microscope. Further, the user must be careful to avoid placing obstructing items in the path of the infrared light. Further still, some cameras used to photograph samples are infrared sensitive. This is specifically a problem in immunolabelling techniques, which require maximum signal-to-noise ratios at minimal fluorescence levels.

Another technique is the use of objective lens heaters. In situations involving small volumes of media, i.e., generally 2 milliliters (ml) or less, used in conjunction with oil-immersion objective lenses, the simplest and most efficient means of keeping cells at a physiological temperature may be to heat the objective lens and limit evaporation with either a sealed specimen chamber or an overlay of oil. For larger volumes of media, an objective heater can be used in conjunction with a stage heater. One method of heating an objective lens is to wrap the lens with a flexible coil of tubing and run water through it at an appropriate temperature. Although this method may accomplish the purpose of heating the objective lens, it is inefficient as it involves adding water lines and expensive water heater and circulator means to maintain a constant temperature. There is also a risk of water damage if lines should leak or break.

Accordingly, it is a principal object of the present invention to provide an improved system for heating a specimen being observed with a microscope.

It is further an object of the present invention to provide an objective lens heating system, which is simple to use, efficient and avoids the risk of damage to the microscope and/or the specimen.

It is yet another object of the present invention to provide a system for maintaining the physiological temperature of a specimen being observed under a microscope, which prevents the objective lens from drawing heat from the specimen dish.

SUMMARY OF THE INVENTION

In its simplest embodiment, the present invention is directed to a sleeve for use in uniformly heating a microscope objective lens. The sleeve comprises a heating element, designed not only to heat the objective lens to a desired temperature, but also maintain the lens at that temperature.

The objective lens heater preferably includes a flexible sleeve adapted to fit over the lens casing. A heating element is associated with the sleeve and may be embedded in the sleeve. Alternatively, it may be placed between the sleeve and the objective lens. There is also provided a means to conduct electrical power to the heating element in order to electrically heat the objective lens casing.

In another embodiment, the present invention is coupled with a microscope stage heating system comprising a temperature-controlled heated specimen support stage adapted to accommodate a specimen holder. Both the objective lens heating device and the support stage are connected to a means to electrically generate and maintain a desired temperature. A thermistor-control element may be applied to the lens heating system to assist in accurately controlling the temperature of the system.

There are several advantages to this invention. First, the present invention provides a system which can provide an even temperature across the entire specimen chamber. The system can also be adapted to provide a temperature gradient, which temperature may be increased or decreased, toward the targeted portion of the specimen. The invention is also advantageous in that it provides a compact means for regulating temperature. Therefore, the invention lends itself well to research procedures which require maximum access to the specimen stage area.

The invention is also adaptable to a variety of microscopes and microscope stages and is less expensive than the prior art designs. Further, objective lens heater sleeves can be fitted around several different objective lenses in a single microscope without interfering with each other. The sleeves are easily removed when required.

Other objects, advantages and features of the present invention will become apparent from the following specification when taken in conjunction with the accompanying drawings.

DETAILED DESCRIPTION OF THE INVENTION

The present invention is specifically directed to situations which would benefit from the use of a resistance-heated objective lens. Situations like this are necessary when a cold objective lens acts like a heat sink, i.e., draws heat from the specimen being observed.

While a heat sink could occur in a system in which the objective lens is close to, but not touching the specimen, it is more likely that it would occur when an oil immersion objective lens actually touches the specimen or the plate or petri dish in which the specimen is contained. A drop of immersion oil is placed between the objective lens and the specimen or specimen dish.

Without proper treatment, the connection between the objective lens and the specimen dish via the immersion oil will cause heat to flow from the warmer object, generally the specimen dish, to the cooler object, the objective, which may disrupt physiological conditions in the specimen dish.

Figure 1:
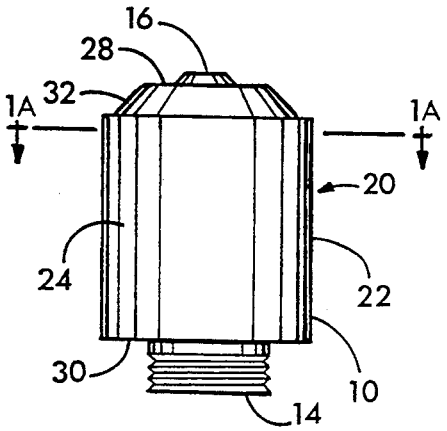
FIG. 1 is side elevated view of the objective lens heat sleeve of the present invention placed on a microscope objective lens.
Figure 2:
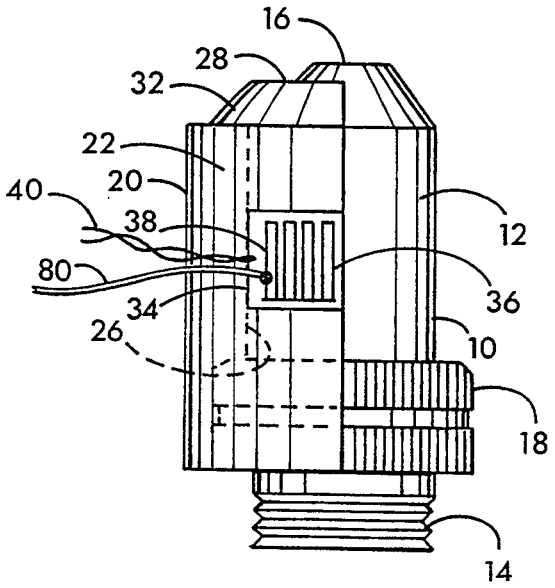
FIG. 2 is a side elevated view of the microscope objective lens of FIG. 1 with a partial cross-sectional view of the objective lens heat sleeve of the present invention.
Figure 1A:
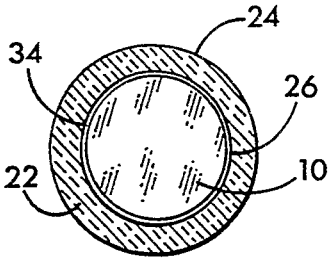
FIG. 1A is a cross-section along lines 1A—1A in FIG. 1.

Turning first to FIGS. 1, 1A and 2, there is illustrated a microscope objective 10 used in conjunction a microscope (not illustrated). The objective 10 is the image forming device in a microscope and includes a lens or system of lenses, which form an image of the specimen being viewed at the focal plane of the microscope eyepiece. The objective 10 includes a tubular shaft 12, generally made of steel or other metal, having at one end a mount 14, illustrated herein as a screw mount for mounting the objective 10 onto a microscope. The other end of the objective 10 is defined by a flush mounted lens 16. A friction collar 18 is provided to assist in the placement or removal of the objective 10.

In order to compensate for the cooler objective lens, an objective lens heater 20 is placed directly on the objective lens 10 via a heat sleeve 22. The heat sleeve 22 is generally a tubular sleeve designed to fit over the objective 10. As illustrated, the heat sleeve has an outer surface 24, an inner surface 26, a distal "lens" opening 28, and a proximal opening 30. The diameter of the distal opening 28 may be reduced, as illustrated at 32, to compensate for the reduction in diameter of the tubular shaft 12 of the objective 10 at the location of the lens 16.

The heat sleeve 22 can be of a rigid construction, i.e., made of polyvinyl chloride or other hard plastic or an acceptable metal, and form-fitted over the objective 10. Preferably, the heat sleeve 22 is formed of a flexible material designed to stretch and provide a snug fit over the tubular shaft 12 of the objective 10. By use of a flexible material, the objective lens heater 20 of the present invention can easily be adapted to stretch and fit over a variety of sizes of objective lens tubular shafts.

A preferred sleeve material has good insulating properties, can be cleaned easily, is able to maintain a long life under many heating cycles, and is flexible. While there are a number of flexible materials suitable for the heat sleeve 22, for purposes of the present invention, the preferred sleeve material is an "RTV silicon elastomer 6382 (Factor II, P.O. Box 1339, Lakeside, Ariz. 85929)."

Figure 3:
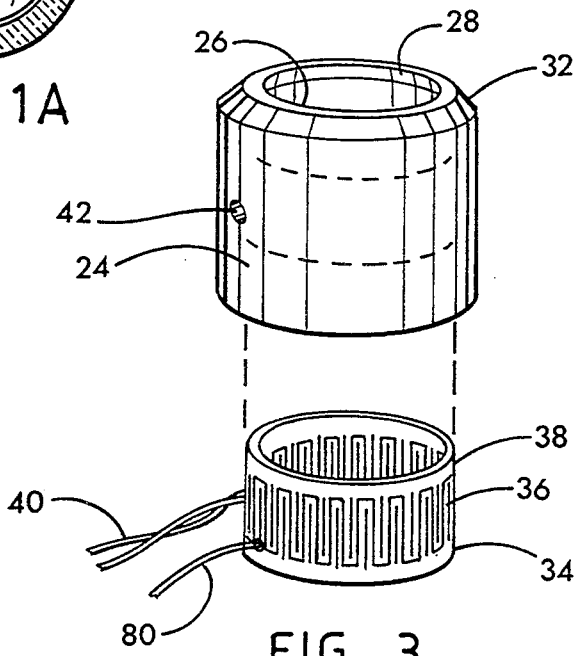
FIG. 3 is an exploded perspective view of the objective lens heat sleeve of the present invention.

Referring now particularly to FIG. 3, the temperature adjustment in the objective lens heater 20 is provided by a heating element 34, which is placed between the interior surface 26 of the heat sleeve 22 and the tubular shaft 12 of the objective 10. The heating element 34 may be affixed, by adhesive or other attachment means known to the art, to the interior surface 26 of the heat sleeve 22 or it may be embedded in the sleeve material when the sleeve is formed. The heating element 34 may be constructed in cylindrical fashion, as illustrated in FIG. 3, or as an elongated tape, which can be manipulated to the desired configuration.

The heating element 34 is a preferably resistance-type heater similarly described in U.S. Pat. No. 4,629,862, which is incorporated herein by reference for a description of the heating element. A preferred heating element 34 is made by Electro-Flex Heat, Inc. (Bloomfield, Conn.) and includes a conductive metal grid 36 sandwiched by a very thin flexible casing 38. In the preferred embodiment, the casing 38 is an electrical insulator such as "KAPTON®," made by E I. Du Pont de Nemours Corporation. The metal grid 36 is placed between two thin layers of KAPTON®.

Thin wire leads 40 extend from the heating element 34 and are passed through the heat sleeve 22 via an opening 42 in the sleeve 22. The wire leads 40 connect the heating element 34 to a power supply 44, illustrated in FIG. 5. The power supply 44 is known to the art and does not form a part of the invention, other than to provide electricity to the heating element 34. A preferred power supply 44 is a 0–30 volt DC power supply unit. This unit is flexible in that it may be placed outside of the work space so that it will not be in the way of surgical manipulation. Means to provide a temperature gradient may also be provided by the power supply 44.

Figure 4:
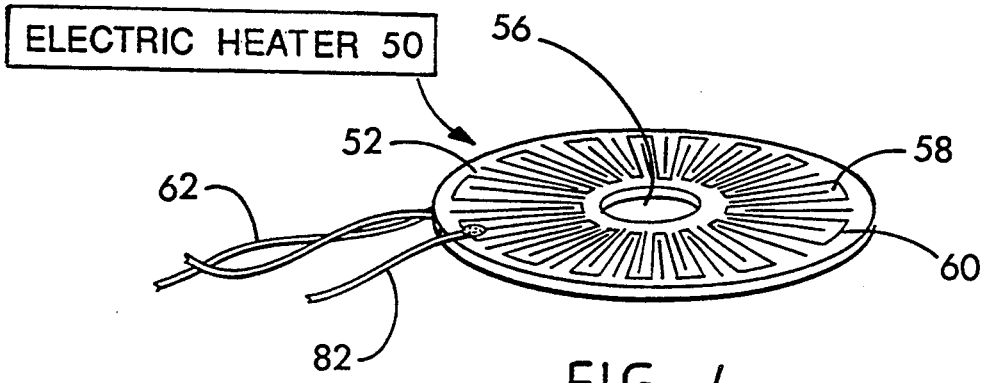
FIG. 4 is a perspective view of the microscope stage heater of the present invention.

In operation, the assembled objective lens heater 20 is placed over the tubular shaft 12 as illustrated in FIGS. 1 and 4. The wire leads 40 are then attached to the power supply 44 and activated, which causes heat to pass through the heating element grid 36, thereby heating the sleeve 22. The objective 10 is then heated to the desired physiological temperature, i.e., between about 32° and 38° C. When the objective 10 is heated to the desired temperature, it may be used to observe live tissue specimens without the inconvenience of acting as a heat/sink to draw heat from the specimen.

Figure 5:
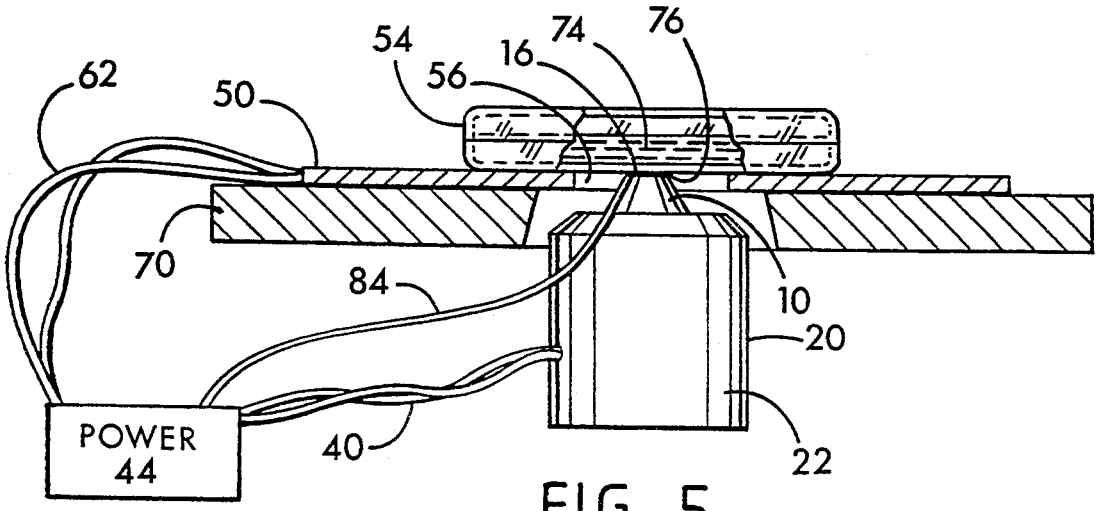
FIG. 5 is a partial cross-sectional side elevational view of a microscope stage illustrating the placement of the objective lens, objective lens heat sleeve, and stage heater.

Referring now to FIGS. 4 and 5, the objective lens heater 20 of the present invention may be used in association with a temperature-controlled stage heater 50. Using the objective lens heater 20 in combination with the stage heater 50 provides a controlled heat environment to the entire specimen dish and avoids the possibility that the objective lens 16 may act as a heat sink, changing the temperature of the specimen being viewed.

In FIG. 4, the stage heater 50 is illustrated as a thin, relatively flat grid or ring 52 designed to support a specimen dish 54, as illustrated in FIG. 5. The stage heater 50 is made of thermally conducted material and includes an aperture 56, designed to align with the stage aperture (described below) in the microscope. The stage heater 50 preferably includes a conductive metal heating grid 58 sandwiched by a flexible casing 60 in a similar manner to the heating element 34 described above. Wire leads 62 extend from the heating grid 58 and are attached to a power supply 44 as described above. The primary distinction between the heating element 34 and the stage heater 50 is in the shape of the two objects and the addition of the aperture 56 in the stage heater 50.

Referring now to FIG. 5, the present invention will be described with respect to an inverted microscope having the objective 10 positioned beneath the microscope specimen platform stage 70. The platform stage 70 includes an aperture 72 to allow the objective 10 access to the specimen dish 54, which is placed on the stage 70.

The objective lens heater 20 is simply installed by sliding the sleeve 22 onto the tubular shaft of the objective 10. The stage heater 50 is then placed on the microscope stage 70 such that the aperture 56 of the stage heater and the aperture 72 of the platform stage 70 are in alignment. After the two heating units 20, 50 are in place, the units are heated to the desired temperature by a controller connected to the lead wires 40, 62 entering the objective lens heater 20 and the stage heater 50 respectively.

The specimen to be observed is illustrated in FIG. 5 in a medium 74 in the specimen dish 54. The specimen dish 54 is placed on the heated stage heater 50. At this point, the objective 10, the stage heater 50 and the tissue medium should all be at the desired physiological temperature.

A drop of oil 76 is placed on the objective lens 16 and the lens 16 is then placed in contact with the specimen dish 54, as illustrated. The specimen may then be observed by the microscope without concern that the objective 10 will act as a heat sink to draw heat away from the tissue medium.

It is within the scope of the invention to place thermistor temperature sensor or thermostat devices at desired locations on the objective lens heater 20 or stage heater 50 to regulate the amount of heat and maintain the required temperature in and between the objective lens heater 20 and the stage heater 50.

Referring to FIG. 2, a thermistor temperature sensor 80, known to the art, may be placed in association with the heating element 34. Referring to FIG. 4, a similar temperature sensor 82 may be placed in association with the heating grid 58 of the stage heater 50. Referring to FIG. 5, a temperature sensor 84 may consist of a thin thermistor wire extending from the power supply 44 to the oil drop 76 between the lens 16 and the specimen dish 54.

Figure 6:
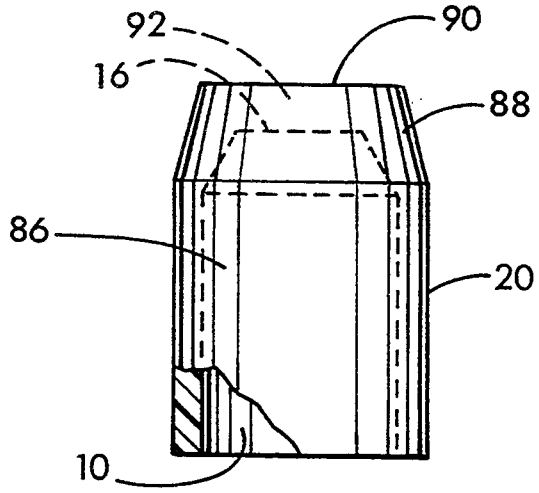
FIG. 6 is a partial cross-sectional side elevational view of another embodiment of the objective lens heat sleeve in placement on an objective lens of a microscope.

Referring now to FIG. 6, there is illustrated an alternative embodiment of the objective lens heater 20 of the present invention. Unlike the heat sleeve 22 illustrated previously, the heat sleeve 86 in FIG. 6 is characterized by a flexible extended collar 88, which extends beyond the lens 16 of the objective 10, and opens into an aperture 90. The collar 88 provides a space 92 between the lens 16 and the aperture 90. The heat sleeve 86 is designed for use with objectives 10 without oil immersion lenses. In this manner the aperture 90 is placed against the specimen dish (not illustrated). Because of the flexibility of the collar 88, the objective 10 may still be manipulated upward or downward from the specimen dish. The collar 88 provides a heated area in the space 92, which regulates the amount of cooler air passing between the specimen dish and objective lens.

It is to be understood that the present invention is not limited to the particular configuration of the apparatus and method of use disclosed in this application, but embraces all such modified forms as come within the scope of the following claims.

What is claimed is:

1. A microscope stage heating system comprising in combination:

a. a microscope having an objective lens;

b. a platform stage that supports a specimen to be examined by the microscope;

c. a heating device placed on the objective lens of the microscope and providing heat to the lens, comprising:

i. a flexible sleeve frictionally fitting over the objective, the heat sleeve including an outside surface, an interior surface, a distal objective lens aperture, and a proximal aperture; and ii. an electric heating element adjacent the interior surface of the heat sleeve, the heating element being positioned to substantially surround the objective when the objective lens heater is in place on the objective; and iii. power controlling means electrically connected to the heating element for generating and controlling heat in the heating element; and d. a temperature-controlled stage heater disposed adjacent the stage to provide heat to the stage.

2. The system of claim 1, wherein the stage heater comprises:

a. a planar platform for receiving the specimen to be heated, the planar platform including a substantially centrally located aperture for allowing the objective lens to view the specimen from beneath the platform;

b. an electrical heating element dispersed across the platform; and c. power controlling means electrically connected to the heating element.

3. The system of claim 1, wherein the heating element is a separate conductive metal grid disposed of within two plies of a thin flexible casing.

4. The system of claim 1 fruther comprising at least one temperature sensor to regulate the amount of heat on the stage heater.

5. A microscope having a microscope objective in combination with a microscope objective heater placed on the objective to provide heat to the objective, the objective heater comprising:

a. a flexible heat sleeve frictionally fit over the objective, the heat sleeve including an outside surface, an interior surface, a distal objective lens aperture, and a proximal aperture; and b. an electric heating element adjacent the interior surface of the heat sleeve, the heating element being positioned to substantially surround the objective when the objective heater is in place on the objective.

6. The objective lens heater of claim 5, wherein the heating element is embedded in the interior surface of the heat sleeve.

* * * * *